United States Patent [19]

Barroero

[11] Patent Number: 4,588,235

[45] Date of Patent: May 13, 1986

[54] REFRIGERATOR DOOR STRUCTURE

[76] Inventor: Louis F. Barroero, 1585 Daniels Dr., San Leando, Calif.

[21] Appl. No.: 648,378

[22] Filed: Sep. 7, 1984

[51] Int. Cl.[4] ..... A47F 3/10

[52] U.S. Cl. ..... 312/138 R; 49/DIG. 2; 49/504; 312/296

[58] Field of Search ..... 49/DIG. 2, 501, 504; 52/731, 732, 40; 312/138 R, 296; 16/75

[56] References Cited

U.S. PATENT DOCUMENTS

| | | | |
|---|---|---|---|
| 1,867,074 | 7/1932 | Hill | 312/138 R |
| 2,858,408 | 10/1958 | Barooero | 312/138 R |
| 2,870,793 | 1/1959 | Bailey | 52/40 X |
| 4,223,482 | 9/1980 | Barroero et al. | 49/386 |
| 4,309,845 | 1/1982 | Schmidt | 49/501 |
| 4,516,356 | 5/1985 | Delman | 49/504 |
| 4,992,063 | 1/1985 | Schock et al. | 49/DIG. 2 |

FOREIGN PATENT DOCUMENTS

| | | | |
|---|---|---|---|
| 1508582 | 4/1978 | United Kingdom | 49/DIG. 2 |

*Primary Examiner*—James T. McCall

*Attorney, Agent, or Firm*—Guy E. Matthews

[57] ABSTRACT

An improved refrigerator door structure, the mounting frame and door thereof being fabricated of fiberglass, fiberglass reinforced thermoplastic, or other light-weight material. An innermost and an outermost glass pane are sealably mounted within the door frame to enclose one or more sheets of heat reflective transparent plastic material space parallel to and laterally from the panes and sealably attached to the frame so as to prevent flow of air past any of the plastic sheets or glass panes. The heat reflective plastic surface serves as a barrier to our flow and also serves as a barrier to radiated heat.

14 Claims, 7 Drawing Figures

REFRIGERATOR DOOR STRUCTURE

This application is an improvement over U.S. Pat. Nos. 4,223,482 and 4,248,489, granted to the Applicant herein.

BACKGROUND OF THE INVENTION

This invention relates to commercial refrigerator doors of the general type used to provide access to the interior of built-in refrigerator compartments of the kind used in grocery stores, for example, and more particularly to a refrigerator door structure constructed of fiberglass reinforced thermoplastics which may be individually constructed, packaged, shipped and installed.

Commercial refrigerator doors of this type generally comprise glass panels mounted in metal frames for use in connection with refrigerator display facilities which may be built-in in large grocery stores or super markets or may be self-contained refrigerator cabinets. Appropriate shelving is generally provided behind the glass panel refrigerator doors in which goods such as milk, cold drinks, perishable goods, or frozen foods, for example, may be displayed for sale. The customer selects the goods desired by looking through the glass panel of the door and removing the goods from the refrigerator. A closure means is generally provided biasing the door to its closed position in order to automatically close the door after it has been opened by the customer.

Since the refrigerated compartments on which the refrigerator doors are used are maintained below normal ambient temperature and often below a freezing temperature, the doors generally utilize a plurality of spaced panes of glass with dead air spaces therebetween in order to provide thermal insulation. The metal frames containing the glass panels may be provided with electrical heaters to prevent the condensation of moisture or the formation of frost on the frame and, in many cases, the glass may also be electrically heated.

A number of doors are generally provided in the opening of a refrigerated compartment in order to enable a customer to obtain access to a particular part of the refrigerated compartment where the desired goods are located. This minimizes the loss of cold air when access to the compartment is desired.

While these refrigerator doors have proven to be effective in carrying out their intended purposes, it is still desireable to provide a refrigerator door constructed of a lighter material such as fiberglass or fiberglass reinforced thermoplastics, so as to reduce opening efforts and transportation costs, while providing for easier manufacturing and assembly of a transparent refrigerator door.

While a wide variety of thermosetting reinforced plastics are available for utilization in the manufacture of such refrigerator doors, the tensile strength of these thermoplastics can be at least doubled by the addition of glass reinforcement. Further, unlike thermosetting reinforced plastics, fiberglass reinforced thermoplastic compounds may be used in conventional molding equipment to produce structural components having increased strength and rigidity, while exhibiting a marked decrease in the co-efficient of thermal expansion. Other beneficial effects achieved with the utilization of fiberglass reinforced thermoplastics are: retention of izod impact strength at very low temperatures, marked improvement in deflection temperatures, increases in hardness and abrasion resistance, as well as, decreases in mold shrinkage, creep, and dimensional changes with humidity.

It is therefore an object of this invention to provide a refrigerator door structure of lighter weight, and which has improved insulation characteristics as compared to conventional doors of the same dimension.

It is also an object of this invention to provide a refrigerator door structure which aids in the reduction of operating energy required by a refrigerator. It is still a further object of this invention to provide a lighter, transparent refrigerator door utilizing fiberglass or other lighter material for the frame and door to reduce opening effort and transportation problems.

SUMMARY OF THE INVENTION

These and other objects of the present invention are accomplished through the provision of an improved refrigerator door structure, the mounting frame and door of such structure being fabricated of fiberglass, fiberglass reinforced thermoplastics, or other light weight material. An innermost and an outermost glass pane are sealably mounted within the door frame to enclose one or more sheets of heat reflective transparent plastic material, spaced parallel to and laterally from the panes and sealably attached to the frame so as to prevent the flow of air past any of the plastic sheets or glass panes. Thus, air may not be heated at the outer pane and then circulated to the inner pane to pass its heat into the refrigerator. The heat reflective plastic surface serves as a barrier to air flow and also serves as a barrier to radiated heat.

DETAILED DESCRIPTION OF THE PREFERRED EMBODIMENTS

Figure 1:
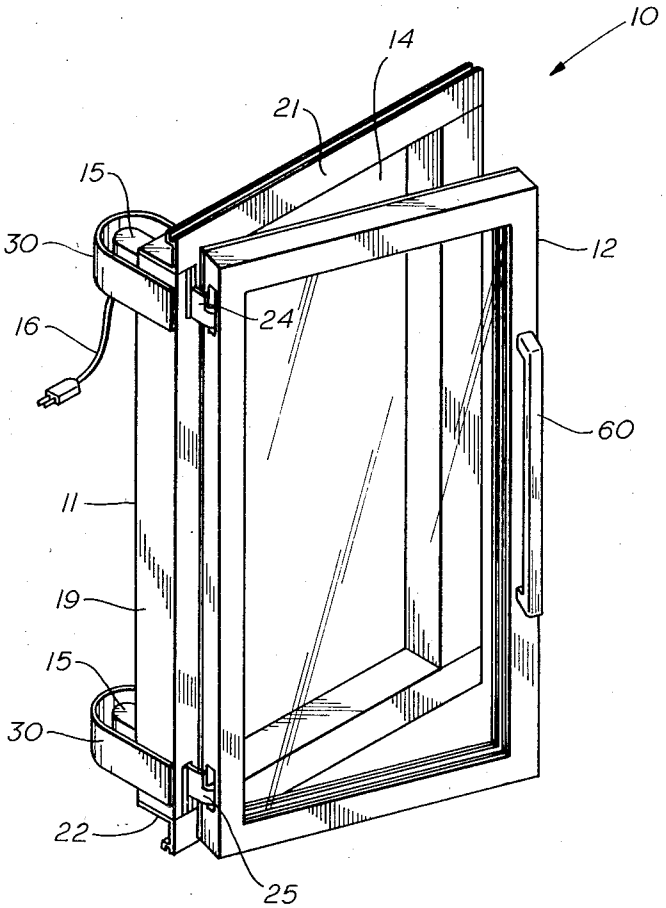
FIG. 1 is a perspective view of the refrigerator door structure of the present invention.

Referring now to FIG. 1, a refrigerator door structure 10 constructed in accordance with the preferred embodiments of this invention is shown. Such door structure is attachable to a refrigerator compartment which may be of the type well-known in the art comprising a well-insulated wall construction with appropriate refrigeration apparatus communicating with the interior thereof.

Typically, an opening is provided through a side wall of the refrigerator compartment during the construction thereof, which opening has become standardized in the prior art and which conventionally includes upper and lower substantially horizontal structural members. According to this invention, the structural members bounding the opening must have flat facing surfaces, and the exterior surface of the refrigerated compartment surrounding the opening must be flat. Conventional construction techniques will tend to produce surfaces having the requisite flatness, or the appropriate L-shape or U-shaped cross-section moulding may be provided about the periphery of the opening, if desired.

The refrigerator door structure 10 according to the teachings of this invention comprises two basic elements, namely, a mounting frame 11 and a door 12 hinged thereto. The mounting frame 11 is of a size slightly less than the spacing between the surfaces bounding the opening in the refrigerator compartment, and includes means at its top and bottom to enable it to be rigidly mounted to the top and bottom surfaces of the refrigerator compartment opening. As can be seen, both the mounting frame 11 and the door 12 are of rectangular configuration.

Figure 2:
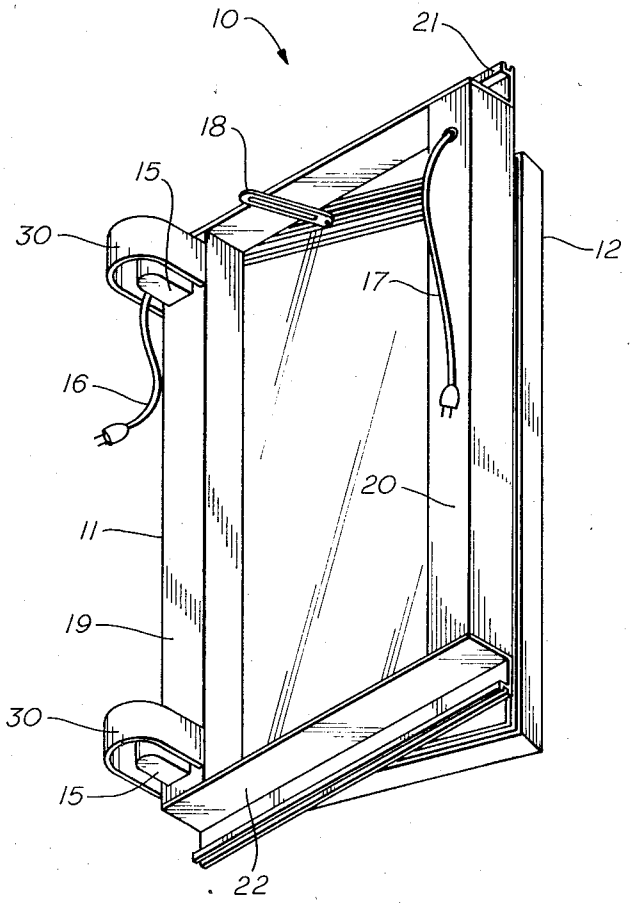
FIG. 2 is a rotated perspective view of the refrigerator door structure of the present invention.

As more clearly depicted in FIG. 2, the rear surface the mounting frame 11 is disposed with appropriate electrical connections 15 for mounting and energizing a light source in the form of a flourescent tube (not shown) thereon. In a typical installation, an electrical conduit means will be mounted along the upper boundary of the opening through the wall of the refrigerator compartment. Thus, an electrical connection cord 16 may be removeably attached to the electrical conduit means to provide power for the flourescent tube light source. In addition, an electrical cord 17 may be appropriately disposed on the rear surface of the mounting frame 11 to provide power for heating elements located therein.

Electrical connections 15 extend horizontally outwardly from the rear surface of the mounting frame 11, and as such, are prone to becoming damaged during shipping, assembly and use. In order to prevent damage to such connections, they are provided with generally U-shaped or semi-circular protector means 30 which are appropriately attached at their terminal ends to the rear of the mounting frame 11.

In the preferred embodiment of this invention, the rectangular mounting frame 11 includes two vertically disposed side members 19, 20 which are held in equally-spaced relation by horizontally disposed top and bottom end members 21, 22. The mounting frame is preferably made from an appropriate fiberglass material with the side members 19, 20 and the top and bottom end members 21, 22 being appropriately conformed as detailed hereinafter.

Figure 3:
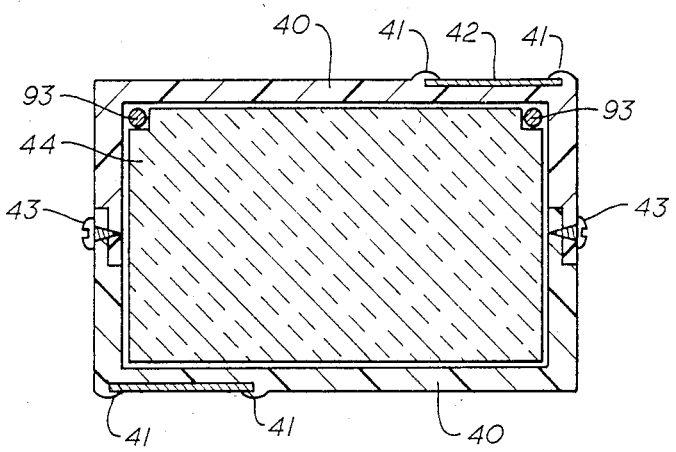
FIG. 3 is a top cross-sectional view of one of the sides of the mounting frame of the preferred embodiment of this invention.

Specifically, side members 19, 20 of mounting frame 11 are cut to the desired length for mounting within the opening of the refrigerator compartment. As shown in FIG. 3, they are formed as U-shaped channel members 40 which are connected to each other at their ends where they form cutaway lap joints, interior and exterior cutaways being disposed alternately on each U-shaped channel member 40. The lap joints are then appropriately fastened together by mechanical fasteners, such as for example, by screws 43 or the like. The U-shaped channel members 40 are also disposed with a plurality of lipped grooves 41 on their exterior surfaces, such lipped grooves being adapted to receive and hold therein stainless steel inserts. After the U-shaped channel members 40 are assembled into mounting frame side members 19, 20 a body of insulating material 44 is disposed therein so as to prevent the passage of cold air from the refrigerator compartment into the atmosphere, and to prevent the passage of hot air from the atmosphere into the refrigerator compartment, as will be obvious to a person having skill in the art. In addition, appropriate electrical heating elements 93 may be placed within mounting frame side members 19, 20 in order to prevent the formation of frost in areas where the mounting frame and door seal against each other.

Figure 4:
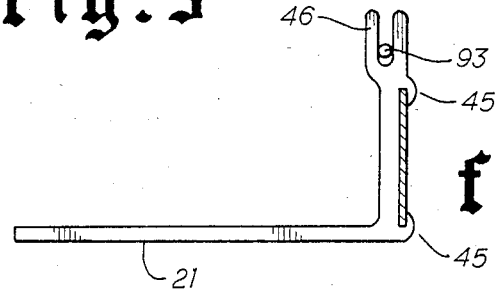
FIG. 4 is a side cross-sectional view of the top end member of the mounting frame of the preferred embodiment of this invention.

Top and bottom end members 21, 22 are configured to detail a general L-configuration in cross-section, as can be seen in FIG. 4 (one shown). These end members 21, 22 are disposed with generally U-shaped flanges 46 which extend along the entire length of their vertically projecting terminal ends. Horizontally disposed lipped grooves 45 are also situated on the exterior surface of the vertically projecting sides of a L-shaped end members 21, 22 for the disposition of stainless steel inserts therein.

Advantageously, the horizontally extending flat bottoms of the L-shaped end members 21, 22 are appropriately attached to the terminal ends of the vertically disposed side members 19, 20 such as for example by screws, so as to provide sufficient strength and rigidity to the mounting frame 11 which they form upon assembly. U-Shaped flanges 46 of end members 19, 20 may also be provided with appropriate electrical heating elements 93, to aid in the prevention of frost formations in areas where the door 12 seals against the mounting frame 11.

In accordance with the preferred embodiment of this invention, two hinge members 24, 25 are spaced from each other along the front surface of mounting frame 11 so that each is adjacent a different end of the side member 19. Hinges 24, 25 may be mounted to side member 19 by any suitable means, but are preferably mounted to such side member through the provision of longitudinally disposed slots which extend from the ends of said side member towards the center thereof.

Figure 5:
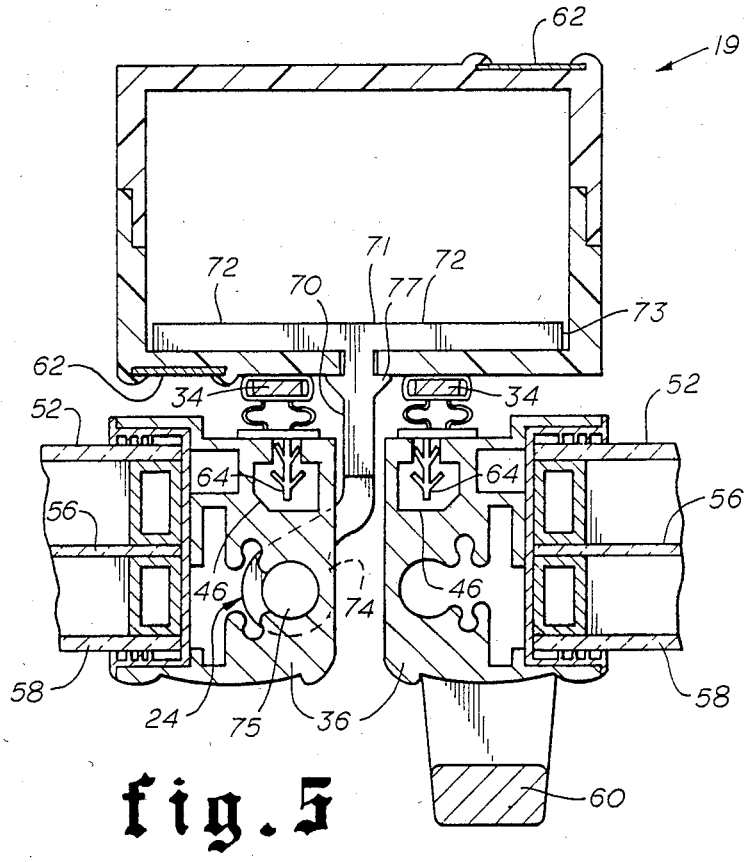
FIG. 5 is an enlarged fragmentary cross-section of the door and mounting frame comprising the refrigerator door structure of the present invention.

As shown in FIG. 5, the mounting flange 70 of the hinge members 24, 25 is preferrably configured to radiate outwardly from the plate 71 thereof such that the edges 73 of the flange 70 of said hinge members 24, 25 may abut the interior sides of the side member 19 into which they are slidingly inserted. This configuration is particularly advantageous, as will be readily seen by those having experience in the art, as such configuration provides more strength and stability to such hinge members 24, 25 and to their deposition within the side member 19. Preferably, the hinge members 24, 25 are fabricated of an extruded aluminum material or the like.

Figure 6:
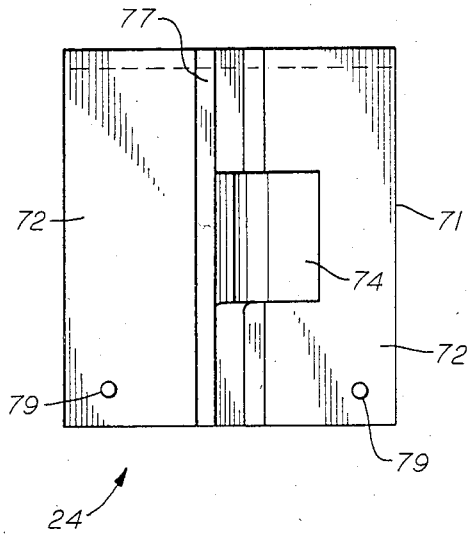
FIG. 6 is a front view of the hinge member of the refrigerator door structure of the present invention.

FIG. 6 illustrates a front view of the hinge members 24, 25 of the refrigerator door structure of the present invention. Preferrably hinge member 24 is identical to hinge member 25, and comprises, as a unitary structure, a flat, vertically extending base plate 70 having a mounting base 71 providing mounting flanges 72 extending transversely of the base plate at one end thereof. The other end of base plate 70 is provided with an integral body 74 which is offset to one side of the base plate 70. A passageway 75 is formed through the offset body 74 of hinge member 24 which is mounted to side member 19, its axis extending parallel to side member 19. Upon assembly, a hinge pin (not shown) is disposed within passageway 75 to cooperate with hinge member 24, 25 in mounting the door 12 of each door structure 10 to side member 19 of mounting frame 11.

Figure 7:
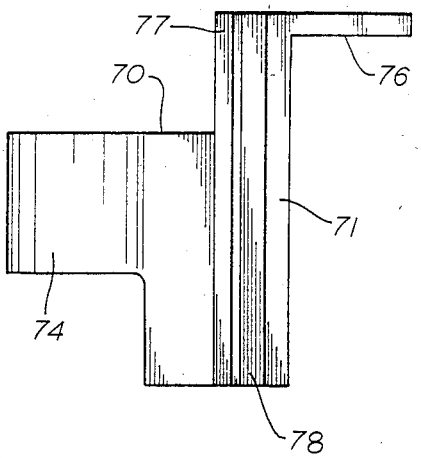
FIG. 7 is a side view of the hinge member of the refrigerator door structure of the present invention.

As can be seen in FIG. 7, mounting base 71 also details a horizontally disposed, radially projecting edge 76 adapted for appropriate connection to end members 21, 22, such as, for example, by screws or the like.

Situated upon base plate 70, between mounting base 71 and offset body 74, is a lip 77 which extends vertically downwardly along, and projects radially outwardly from, base plate 70. Such arrangement serves to define a slot 78 into which the front surface of side members 19 is disposed (FIG. 5) to lend strength and stability to hinge member 24 and its placement within side member 19.

Referring again to FIG. 6, flanges 72 of mounting base 71 may advantageously have a plurality of apertures 79 disposed therethrough for the insertion of appropriate fasteners therein to secure the mounting flanges 72 to the side member 19.

While the refrigerator door 12 is of rectangular configuration, as previously indicated, the width of the door is substantially less than that of the mounting frame 11 while being of a size sufficient to completely cover the opening 14 in the mounting frame 11. As can be seen in FIG. 5, the door frame 36 is shaped to provide sufficient strength and rigidity thereto, and also to provide cooperating recesses such as dovetail 28 to receive stainless steel inserts 40 therein. Door frame 36 may be formed by cutting the fiberglass or fiberglass reinforced thermoplastic construction to lengths as required for a given door, mitering the ends, and appropriately fastening the corners together so as to produce the rectangular shape shown in FIGS. 1 and 2.

An elastic seal 34, which extends continuously around the inner face of frame 36, may be retained within the frame by pressing the small edge 64 of the seal 34 into continuous groove 46 formed in frame 36.

Extruded elastic seal 48 is formed to cooperate with recess 50 formed in frame 36 so as to receive inner glass pane 52, rectangular spacer tube 54, heat reflective plastic sheet 56, spacer tube 54, and outer glass pane 58 so as to seal around the outer edges of the panes and plastic sheet against the flow of air.

Ridges 60 may be formed in elastic seal 48 so as to maintain a seal between the transparent members and surfaces abutting their sides and yet allow for minor differences in thickness of the stack height of the panes, tubes and sheet.

Heat reflective transparent plastic sheet 56 may be soft so as to be shipped in a roll, and it is therefore a requirement to stretch it taut before locking it in place by means of tubes 54.

It may now be appreciated that an improved thermal barrier has been formed while providing visable capability through the door. It may also be appreciated that the disclosed mounting frame and door provide an improved composite refrigerator door structure which is more energy efficient while being of lighter weight. Although only one sheet 56 is show, it is contemplated that in applicable situations, two or more sheets may be used to create additional barriers, a like number of tubes 54 being furnished for spacing between the sheets.

As can be clearly seen in FIG. 2, door 12 may be opened a distance which is more than sufficient to permit entry into the refrigerated compartment to which it is attached, but is prevented from an inordinate opening through the provision of a slotted opening limiter means 18 which is appropriately connected to the mounting frame 11 and the door 12 by appropriate swivel means as is well known in the art. The door is biased toward closing sufficiently to close when released by the user and to compress seal 34 sufficiently to seal the door frame against the surface of side member 20 of mounting frame 11.

Handle means 60 may be appropriately affixed to the side of the door 12 opposite the side from which the hinge members 24, 25 are disposed, and is disposed thereon so as to extend virtually along the length thereof.

As best seen in FIGS. 1 and 5, the door 12 is mounted to the mounting frame 11, and specifically to side member 19 thereof, by means of hinge members 24, 25.

It is to be understood that the present invention is not to be taken as being limited to the accompanying drawings and specification. While the particular embodiment of the present invention has been illustrated and described herein, it is not intended to limit the invention to such disclosure, but changes and modifications may be made therein and thereto.

It is also to be understood that the phraseology and terminology herein employed are for purposes of description and not a limitation, since the scope of the present invention is denoted by the appended claims.

What is claimed is:

1. A fiberglass refrigerator door structure attachable to an opening in a refrigerator compartment, said structure comprising, as a composite;

(a) a mounting frame including an opening therein for entry into said refrigerator compartment and being of a size slightly less than that of the surfaces bounding said opening in said refrigerator compartment, said mounting frame having two vertically disposed side members held at equally-spaced relation by top and bottom end members, said side members being formed of two U-shaped channel members appropriately fastened together, and said top and bottom end members detailing a general "L" configuration while having generally U-shaped flanges extending along the entire length of their vertically projecting terminal ends, and (b) a door hingedly connected to said mounting frame, said door being of a width slightly less than that of said mounting frame while being of a size sufficient to completely cover said opening in said mounting frame.

2. A fiberglass refrigerator door structure attachable to an opening in a refrigerator compartment, said structure comprising as a composite;

(a) a mounting frame including an opening therein for entry into said refrigerator compartment being of a size slightly less than the spacing between the surfaces bounding said opening of said refrigerator compartment, and having means at its top and bottom to rigidly mount said mounting frame thereto, said mounting frame comprising two vertically disposed side members, top and bottom end members attached to said vertically disposed side members, two hinge members attached to the front surface of one of said side members through the provision of longitudinally disposed slots into which said hinge members are slidingly inserted, electrical connections mounted to the rear surface of one of said side members and being spaced apart from each other for mounting and energizing a light source, protective means disposed around said electrical connections, an electrical cord disposed upon the rear surface of the other of said side members of said mounting frame to provide power for heating elements located therein, and stainless steel inserts mounted to the surfaces of said vertically disposed side members and said top and bottom end members; and (b) a door hingedly connected to said mounting frame, said door being of a width substantially less than that of said mounting frame while being of a size sufficient to completely cover said opening in said mounting frame, said door including a frame configured to provide recesses on the front surface thereof for receiving stainless steel inserts therein, an elastic seal extending continuously around the interior surface of said frame, said frame also detailing recesses to receive therein in proper sequence, an inner glass pane, spacer tubes, heat reflective plastic sheet, and an outer glass pane so as to seal against the flow of air.

3. The door structure as defined in claims 1 and 2, wherein said vertically disposed side members are formed of U-shaped channel members connected to each other at their terminal ends where they form cutaway lap joints, interior and exterior cutaways being disposed alternately on each of said channel members, said lap joints being appropriately fastened together by mechanical fasteners.

4. The door structure as defined in claims 1 and 2, wherein said U-shaped channel members are disposed with a plurality of lipped grooves on their exterior surfaces, such lipped grooves being adapted to receive and hold therein stainless steel inserts.

5. The door structure as defined in claims 1 and 2, wherein a body of insulating material is disposed within said side members of said mounting frame so as to prevent the passage of cold air from the refrigerator compartment into the atmosphere and to prevent the passage of hot air from the atmosphere into the refrigerator compartment.

6. The door structure as defined in claims 1 and 2, wherein electrical heating elements are appropriately placed within said mounting frame side members.

7. The door structure as defined in claims 1 and 2, wherein horizontally disposed lipped grooves are situated on the exterior surfaces of the vertically projecting sides of said L-shaped end members for disposition of stainless steel inserts therein.

8. The door structure as defined in claims 1 and 2, wherein the U-shaped flanges of said end member are provided with electrical heating elements.

9. The door structure as defined in claim 2, wherein the mounting flanges of said hinge members are configured to radiate outwardly from the plates thereof such that the edges of the flanges may abut the interior sides of said side members into which they are slidingly inserted, said hinge members being fabricated of an extruded aluminum material.

10. The door structure as defined in claims 1 and 2, wherein said door frame may be formed by cutting a fiberglass extrusion to appropriate lengths, mitering the ends, and fastening the corners together by appropriate means.

11. A fiberglass refrigerator door structure attachable to an opening in a refrigerator compartment, said structure comprising, as a composite:

(a) a mounting frame including an opening therein for entry into said refrigerator compartment being of a size slightly less than the spacing between the surfaces bounding said opening of said refrigerator compartment, and having means at its top and bottom to rigidly mount said mounting frame thereto, said mounting frame comprising two vertically disposed side members, top and bottom end members attached to said vertically disposed side members, two hinge members attached to the front surface of one of said side members through the provision of longitudinally disposed slots into which said hinge members are slidingly inserted, electrical connections mounted to the rear surface of one of said side members and being spaced apart from each other for mounting and energizing a light source, protective means disposed around said electrical connections, an electrical cord disposed upon the rear surface of the other of said side members of said mounting frame to provide power for heating elements located therein, insulating material disposed within said side members, electrical heating elements placed within said side members in order to prevent the formation of frost in areas where the mounting frame and door seal against each other, and stainless steel inserts mounted to the front surfaces of said vertically disposed side members and said top and bottom end members; and (b) a transparent door hingedly connected to said mounting frame, comprising a rectangular frame of sufficient strength and rigidity for mounting said door so as to seal a refrigerator wall opening, said door being of a width substantially less than that of said mounting frame while being of a size sufficient to completely cover said opening in said mounting frame, said door including a frame configured to provide lipped grooved on the front surfaces thereof for receiving stainless steel inserts therein, means for effecting a seal against air flow between the door frame and the wall when the door is closed, a first transparent pane of glass or the like mounted within the frame to seal against outside air, a second transparent pane of glass or the like mounted within the frame to seal against air within the refrigerator, and one or more sheets of transparent, heat reflective plastic mounted within the frame and spaced laterally between the first and second panes of glass so as to seal against air flow from one pane to the other.

12. The door structure as defined in claim 1, 2, 9 and 11, wherein said hinge members comprises, as a unitary structure:

(a) a flat, vertically extending base plate;

(b) a mounting base extending transversely of said base plate at one end thereof, said mounting base providing mounting flanges;

(c) an integral body disposed on the other side of said base plate, said integral body being offset to one side of said base plate and having a passageway formed therethrough;

(d) a horizontally disposed, radially projecting edge extending from one end of said mounting base; and (e) a lip extending vertically downwardly along, and projecting radially outwardly from, said base plate, said lip being situated upon said base plate between said mounting base and said offset body to define a slot into which the front surface of said side member is disposed.

13. The door structure as defined in claims 1, 2, 9 11 and 12, wherein said hinge members are spaced from each other along the front surface of said mounting frame such that each is situated adjacent a different end of said side member, said hinge members preferrably being slidingly mounted to said side member through the provision of longitudinally disposed slots, said slots extending from the ends of said side member towards the center thereof.

14. The door structure as defined in claims 1, 2 and 11, wherein said door structure is fabricated from a lightweight material such as fiberglass or a fiberglass reinforced thermoplastic.

* * * * *